US008638186B1

(12) United States Patent
LaPoint

(10) Patent No.: US 8,638,186 B1
(45) Date of Patent: Jan. 28, 2014

(54) MAGNETIC ARRAY

(71) Applicant: David Allen LaPoint, Palm Desert, CA (US)

(72) Inventor: David Allen LaPoint, Palm Desert, CA (US)

( * ) Notice: Subject to any disclaimer, the term of this patent is extended or adjusted under 35 U.S.C. 154(b) by 0 days.

(21) Appl. No.: 13/624,857

(22) Filed: Sep. 21, 2012

(51) Int. Cl.
*H01F 7/02* (2006.01)

(52) U.S. Cl.
USPC ..... 335/306

(58) Field of Classification Search
USPC ..... 335/306; 210/222–223; 123/536–539
See application file for complete search history.

(56) References Cited

U.S. PATENT DOCUMENTS 5,886,609 A * 3/1999 Stelter ..... 335/306
6,747,537 B1 * 6/2004 Mosteller ..... 335/306

* cited by examiner

*Primary Examiner* — Ramon Barrera

(57) ABSTRACT

A magnetic array with a bowl-shaped array of magnets oriented to induce a structured and oriented ionic flow towards a focal point. The magnets include a north pole and a south pole oriented to induce the ionic flow. Either poles face inwardly from the array to induce an ionic flow. Varying the size, dimensions, strength, and orientation of the magnets manipulates the ionic flow to a desired strength and velocity. The ionic flow increases in strength and concentration when in proximity to the narrow end. The ionic flow forces objects inside the array towards a hole in the narrow end.

18 Claims, 11 Drawing Sheets

MAGNETIC ARRAY

CROSS-REFERENCE TO RELATED APPLICATIONS

The present Utility patent application claims priority benefit of the U.S. provisional application for patent serial number 61586114 filed on 12, Jan. 2012 under 35 U.S.C. 119(e). The contents of this related provisional application are incorporated herein by reference for all purposes to the extent that such subject matter is not inconsistent herewith or limiting hereof.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

FIELD OF THE INVENTION

One or more embodiments of the invention generally relate to magnets. More particularly, one or more embodiments of the invention relate to focusing and orienting ionic flows and magnetic fields.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a magnet is a material or object that produces an ionic flow and a magnetic field. The ionic flow is invisible but is responsible for the most notable property of a magnet: a force that pulls on other ferromagnetic materials, such as iron, and attracts or repels other magnets.

Typically, a magnet's magnetic moment is a vector that characterizes the magnet's overall magnetic properties. For a bar magnet, the direction of the magnetic moment points from the magnet's south pole to its north pole.

Typically, an ion is an atom or molecule in which the total number of electrons is not equal to the total number of protons, giving it a net positive or negative electrical charge.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
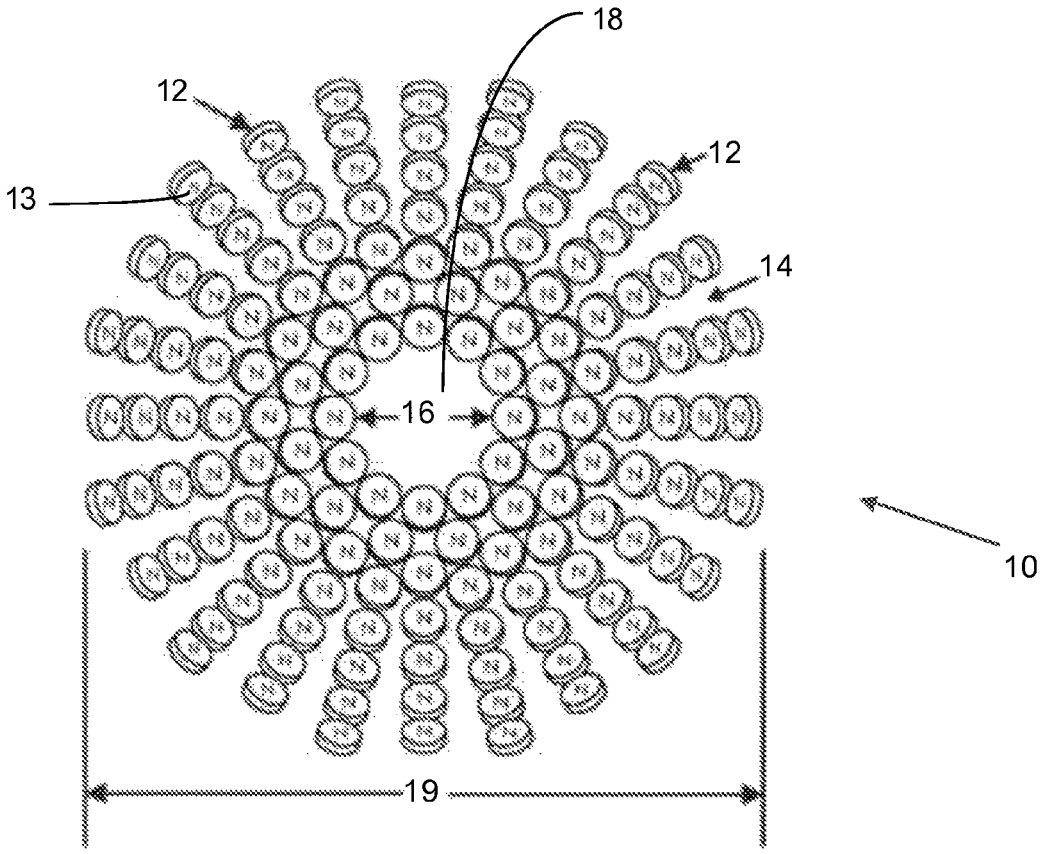
FIG. 1 illustrates a top view of an exemplary magnetic array, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of magnetic arrays that may be provided by preferred embodiments of the present invention. In one embodiment of the present invention, a magnetic array may include a bowl-shaped array of magnets oriented to induce a structured and oriented ionic flow. The magnets may include a north pole oriented to induce the ionic flow. In yet another embodiment, the magnets may include a south pole oriented to induce the ionic flow. Either of the poles may face inwardly from the array to induce the ionic flow. The ionic flow may flow from a wide end towards a narrow end of the array. In some embodiments, the ionic flow may increase in strength and concentration when in proximity to the narrow end of the array. In some embodiments, the ionic flow may force at least one object positioned inside the array towards an aperture positioned in the narrow end. However, in other embodiments, the ionic flow may manipulate and orients objects positioned inside the array for therapeutic effects and scientific studies.

In one embodiment of the present invention, the ionic flow may reverse direction at a point past the aperture. The at least one object may also reverse direction in accordance to the ionic flow. In this manner, the at least one object may be repulsed after passing through the aperture.

In one embodiment of the present invention, the array may include magnets of varying sizes and strengths depending on the desired ionic flow and/or magnetic field to be generated. The size, dimension, orientation, and strength of the multiplicity of magnets may be manipulated to provide myriad combinations of ionic flow and magnetic fields. In this manner, the at least one object may be manipulated as desired.

FIG. 1 illustrates a top view of an exemplary magnetic array, in accordance with an embodiment of the present invention. In the present embodiment, the magnetic array 10 may include a pair of poles. In some embodiments, an "N" may position on one end of the multiplicity of magnets 12 to represent the multiplicity of north poles 13, and an "S" may position on the opposite end of each magnet to represent the multiplicity of south poles. In some embodiments, the magnets may include disc magnets that are magnetized axially with the north poles on one side of the disc magnet and south poles on the opposite side of the disc. The magnets may vary in size, shape, and magnetic density, according to the desired ionic flow, magnetic field, and effects produced. A space 14 of various dimensions may separate rows of the magnets. The multiplicity of magnets may include different shapes, including, without limitation, disk, square, triangle, circle, oval, rectangle, rhombus, pentagon, hexagon, polygon, sphere, cube, and mixed shapes.

In some embodiments, the magnets may include a bowl shaped array, which may orient to induce a structured and oriented ionic flow. The ionic flow may, in turn, induce a magnetic field having both direction and magnitude. The multiplicity of magnets may include the multiplicity of north poles oriented to induce the ionic flow. In yet another embodiment, the multiplicity of magnets may include the multiplicity of south poles oriented to induce the ionic flow. Either of the poles may face inwardly, towards the aperture, to induce an ionic flow. The ionic flow may flow from a wide end towards a narrow end of the array. In some embodiments, the ionic flow may increase in strength and concentration when in proximity to the narrow end of the array. In some embodiments, the ionic flow may force at least one object positioned inside the array towards an aperture positioned in the narrow end. However, in other embodiments, the ionic flow may manipulate and orients objects positioned inside the array for therapeutic effects and scientific studies.

Those skilled in the art, in light of the present teachings will recognize that the arrays may be orderly and symmetrical, but this is not necessary. However, the same magnetic poles may face inwardly to provide the desired ionic flow through the array. In some embodiments, additional dimensions, including, without limitation, diameter, depth, base, and radius of the parabolic curve may vary as well as the shape, size, strength, number and placement of the magnets, as long as a spacing between the magnets is not too great so as to result in a negative effect on the desired field created by the array. In one embodiment, the base 16 may be varied according to the desired effects on the ionic flow through the aperture. In one embodiment, when the base is smaller, the ionic flow is more, and therefore the velocity of the flow of ions may increase. In one embodiment, the diameter 19 may be varied according to the ionic flow, magnetic field, and desired effects on the at least one object. In one embodiment, increasing the diameter may result in an increased quantity of the ionic flow passing into the array if a magnetic density is increased in proportion to the size of the array.

Those skilled in the art, in light of the present teachings will recognize that increasing the diameter and the depth of the array increases the magnetic strength proportionally to the size of the array. The ionic flow through the aperture 18 in the base may also increase. In one embodiment, if all the dimensions remain the same, yet the base becomes smaller, the velocity of the ionic flow may increase. In yet another embodiment, if the aperture is small, the ionic flow may be restricted. In one alternative embodiment, the aperture may not be utilized.

Those skilled in the art, in light of the present teachings will recognize that magnetic fields include various classes of vortex waves. The vortex waves may be described with equations, including, without limitation, Landau-Lifshitz equation, continuum Heisenberg model, Ishimori equation, and nonlinear Schrödinger equation.

Figure 2:
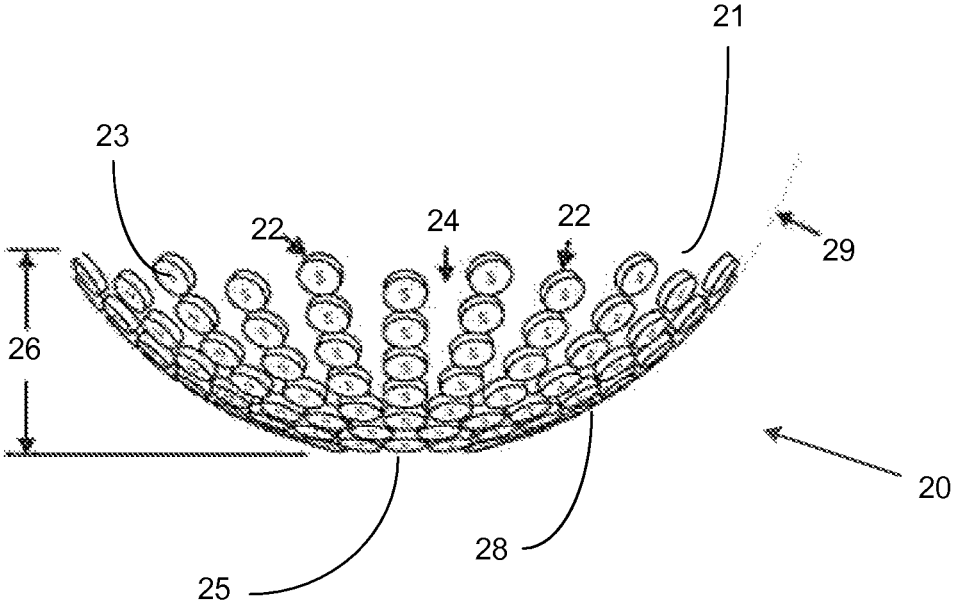
FIG. 2 illustrates a side view of an exemplary magnetic array with an exemplary arrangement and an exemplary orientation of the multiplicity of magnets in an exemplary array, in accordance with an embodiment of the present invention.

FIG. 2 illustrates a side view of an exemplary magnetic array with an exemplary arrangement and an exemplary orientation of the multiplicity of magnets in an exemplary array, in accordance with an embodiment of the present invention. In the present embodiment, the magnetic array 20 may include various sizes and dimensions. In some embodiments, the efficacy of the multiplicity of magnets 22 may be affected by varying the diameter, radius 29 and the depth 26 of the array 28 without varying the size of the aperture at a base of the array. A space 24 may separate the rings of magnets. For example, without limitation, in the present embodiment, the array may include an innermost ring of the multiplicity of magnets. However, the quantity of rings of magnets in proximity to the narrow end 25 may vary, while the wide end 21 may be similar. In yet another embodiment, the diameter and depth may vary, while a radius 112 of the parabolic curve of the array may be identical. In some embodiments, the multiplicity of magnets may include the multiplicity of north poles oriented to induce the ionic flow. In yet another embodiment, the multiplicity of magnets may include the multiplicity of south poles 23 oriented to induce the ionic flow. Either of the poles may face inwardly, towards the aperture, to induce an ionic flow. It should be noted that in some embodiments the magnets could be faced outwards, wherein given the present approach of using axially magnetized magnets, when one pole faces inwards the opposite pole faces outwards.

Figure 3:
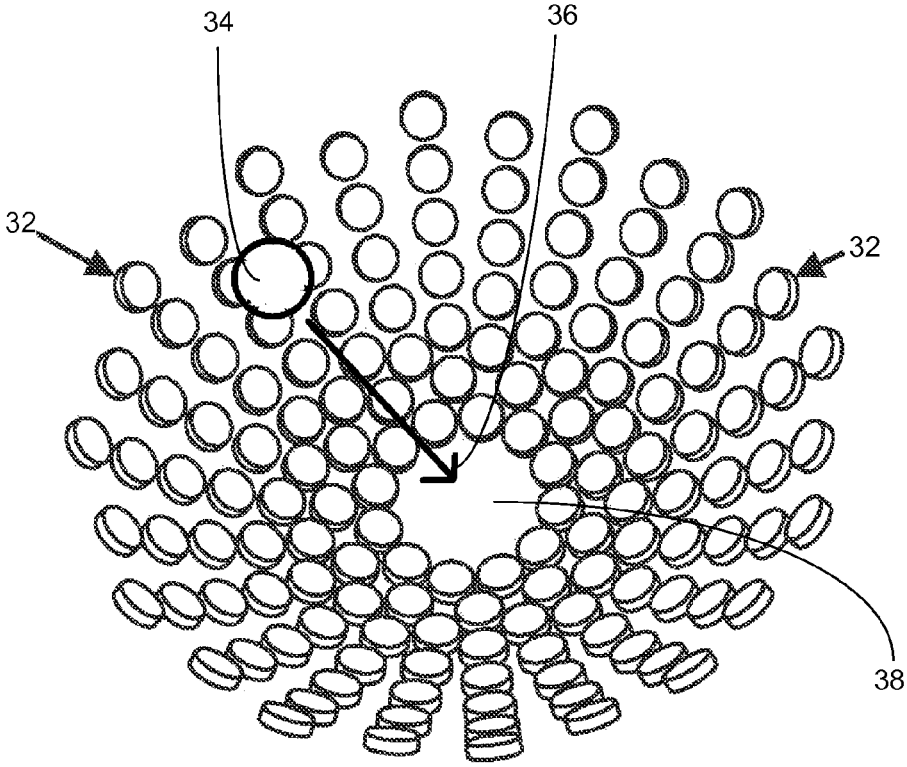
FIG. 3 illustrates an orthographic view of an exemplary magnetic array illustrating the arrangement of the multiplicity of magnets in an exemplary array, in accordance with an embodiment of the present invention.

FIG. 3 illustrates an orthographic view of an exemplary magnetic array illustrating the arrangement of the multiplicity of magnets in an exemplary array, in accordance with an embodiment of the present invention. In the present embodiment, the array may include the multiplicity of magnets 32 with varying sizes and strengths depending on the desired ionic flow 36 to be induced. The size, dimension, orientation, and strength of the multiplicity of magnets may be manipulated to provide myriad combinations of ionic flow and magnetic fields. In this manner, the at least one object may 34 be forced towards the aperture 38 and manipulated as desired.

Figure 4:
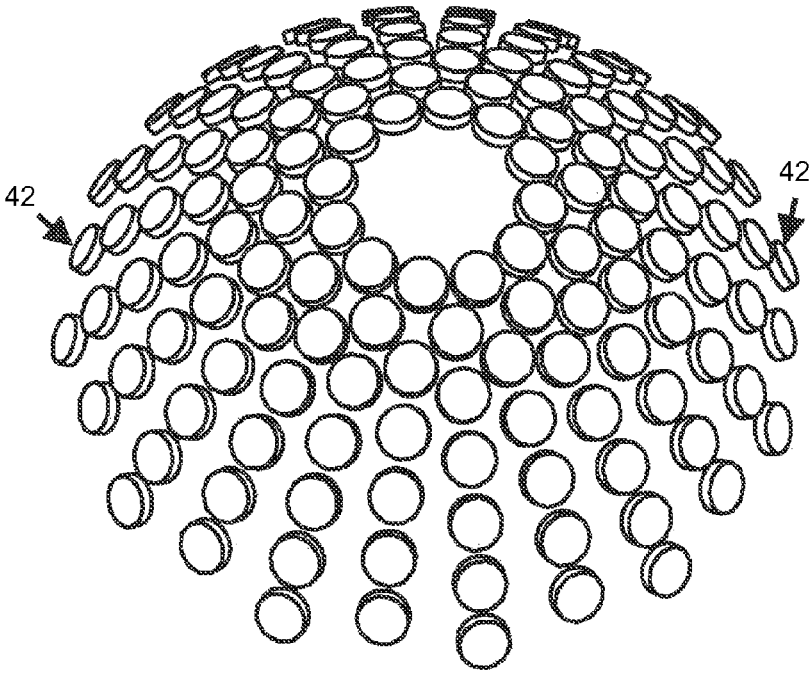
FIG. 4 illustrates an inverted view of an exemplary magnetic array illustrating the arrangement of the multiplicity of magnets in an exemplary array, in accordance with an embodiment of the present invention.

FIG. 4 illustrates an inverted view of an exemplary magnetic array illustrating the arrangement of the multiplicity of magnets in an exemplary array, in accordance with an embodiment of the present invention. In the present embodiment, the array may include the multiplicity of magnets 42. The magnets may induce the ionic flow to flow from the wide end towards the narrow end. However, the ionic flow may reverse direction at a point past the aperture. The at least one object may also reverse direction in accordance to the ionic flow. In this manner, the at least one object may be repulsed after passing through the aperture.

Figure 5:
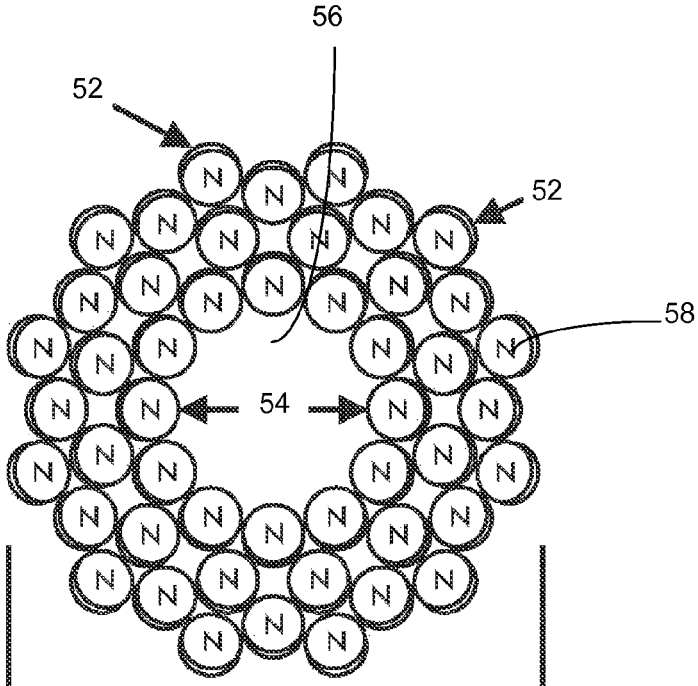
FIG. 5 illustrates a top view of an exemplary magnetic array illustrating the arrangement of the multiplicity of magnets in an exemplary array, in accordance with an embodiment of the present invention.

FIG. 5 illustrates a top view of an exemplary magnetic array illustrating the arrangement of the multiplicity of magnets in an exemplary array, in accordance with an embodiment of the present invention. In the present embodiment, FIG. 5 and FIG. 1 illustrate substantially similar magnetic arrays, yet utilize different dimensions for the array and the multiplicity of magnets 52. For example, without limitation, the innermost ring of the magnets may be substantially similar. Yet, the quantity of rings of magnets in proximity to the narrow end may vary. Therefore the diameter and depth of FIGS. 5 and 1 may vary, while the radius and the base 54 of the parabolic curve of the array remain identical. The aperture 56 and the multiplicity of north poles 58 may also be varied in the present embodiment.

Figure 6:
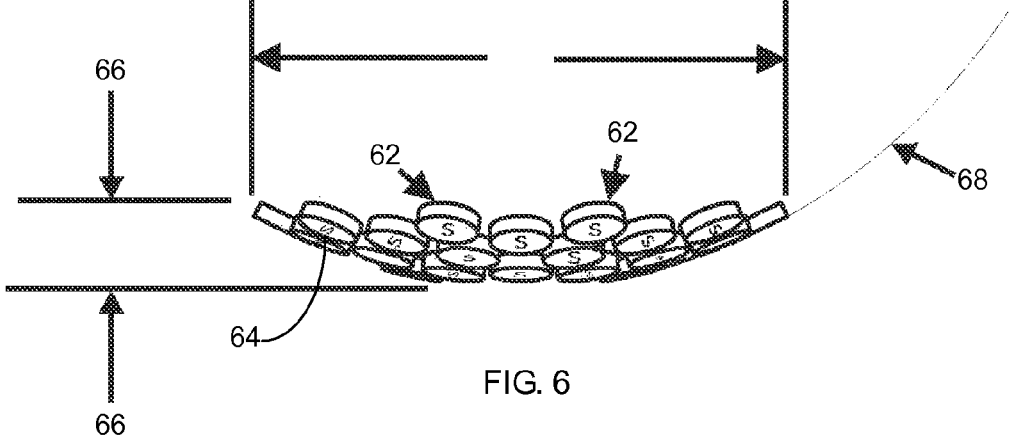
FIG. 6 illustrates a side view of an exemplary magnetic array illustrating the arrangement of the multiplicity of magnets in an exemplary array, in accordance with an embodiment of the present invention.

FIG. 6 illustrates a side view of an exemplary magnetic array illustrating the arrangement of the multiplicity of magnets in an exemplary array, in accordance with an embodiment of the present invention. In the present embodiment, the magnetic array may utilize the multiplicity of magnets 62 for performing numerous therapeutic and scientific functions. Those skilled in the art, in light of the present teachings will recognize that an organic object in the field of influence of the magnetic array may acquire properties that result in a structured and orderly cell structure. For example, without limitation, the use of the magnetic array for therapeutic treatment on humans, animals, and plants. However, the magnetic array may also provide other beneficial uses in the fields of particle physics research, energy production, and air cleaning. However, it is contemplated that many other applications produced by the magnetic array may be realized when the magnets are arranged in various patterns that vary the number and strength of the magnets. Advantageous effects may also be realized by varying the depth 66 and the radius 68 of the hyperbolic curve for the array, while at the same time varying the strength of the magnets and the size and shape of the magnets according to the ionic flow and the magnetic field desired. The multiplicity of south poles 64 may also be varied.

Figure 7:
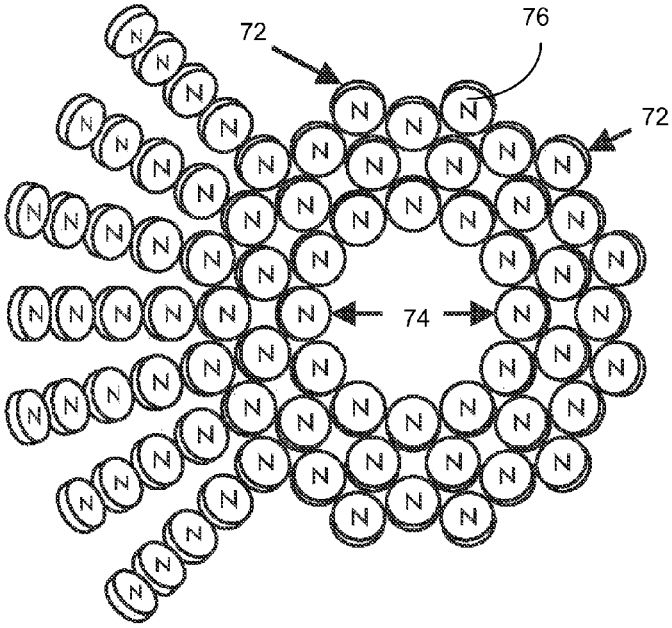
FIG. 7 illustrates a top view of an exemplary magnetic array illustrating the arrangement of the multiplicity of magnets in an exemplary array, in accordance with an embodiment of the present invention.

FIG. 7 illustrates a top view of an exemplary magnetic array illustrating the arrangement of the multiplicity of magnets in an exemplary array, in accordance with an embodiment of the present invention. In the present embodiment, the dimensions and the size, shape, number, pattern, strength, and orientation of the multiplicity of north poles 76 for the multiplicity of magnets 72 may vary greatly. For example, without limitation, the dimensions may be so small that the magnetic array may be microscopic. On the other end of the spectrum, the dimensions may be as large as feasible to construct. In one alternative embodiment, the magnetic array may be constructed so that the diameter 74 of the magnetic array may be measured in miles.

Figure 8:
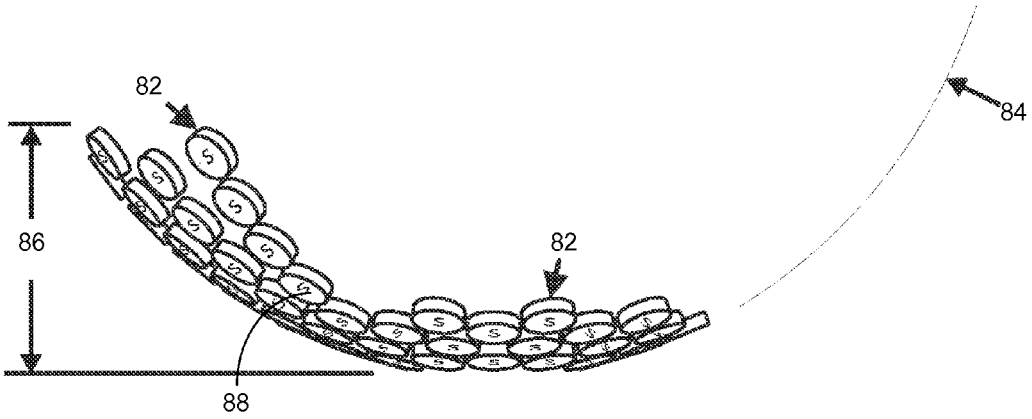
FIG. 8 illustrates a side view of an exemplary magnetic array illustrating the arrangement of the multiplicity of magnets in an exemplary array, in accordance with an embodiment of the present invention.

FIG. 8 illustrates a side view of an exemplary magnetic array illustrating the arrangement of the multiplicity of magnets in an exemplary array, in accordance with an embodiment of the present invention. In the present embodiment, the multiplicity of magnets 82 may be microscopic in size and have very low magnetic strength. Each magnet may be constructed of extremely weak magnetic material or of extremely strong magnetic material according to the properties desired of the ionic flow and the magnetic field produced by the magnetic array. These variable properties may be combined with various radiuses 84 of the hyperbolic curve, depths 86, and variable oriented south poles 88 to produce different effects on the at least one object.

Figure 9:
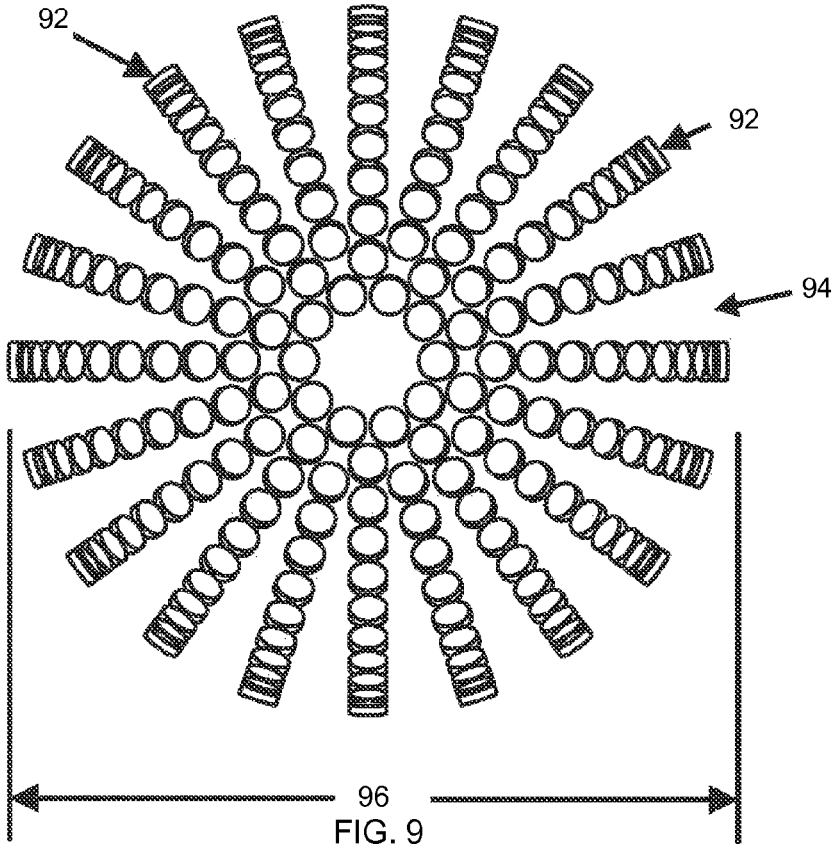
FIG. 9 illustrates a top view of an exemplary magnetic array illustrating the arrangement of the multiplicity of magnets in an exemplary array, in accordance with an embodiment of the present invention.

FIG. 9 illustrates a top view of an exemplary magnetic array illustrating the arrangement of the multiplicity of magnets in an exemplary array, in accordance with an embodiment of the present invention. In the present embodiment, the multiplicity of magnets may include magnets of exactly the same size and strength. Those skilled in the art, in light of the present teachings will recognize that the difference between the arrays may be affected by the number of the multiplicity of magnets 92 around the aperture at the bottom of the array. Since the space 94 between the rows or rings of magnets may be similar, the size of the base 96 of the aperture may also vary the ionic flow.

Figure 10:
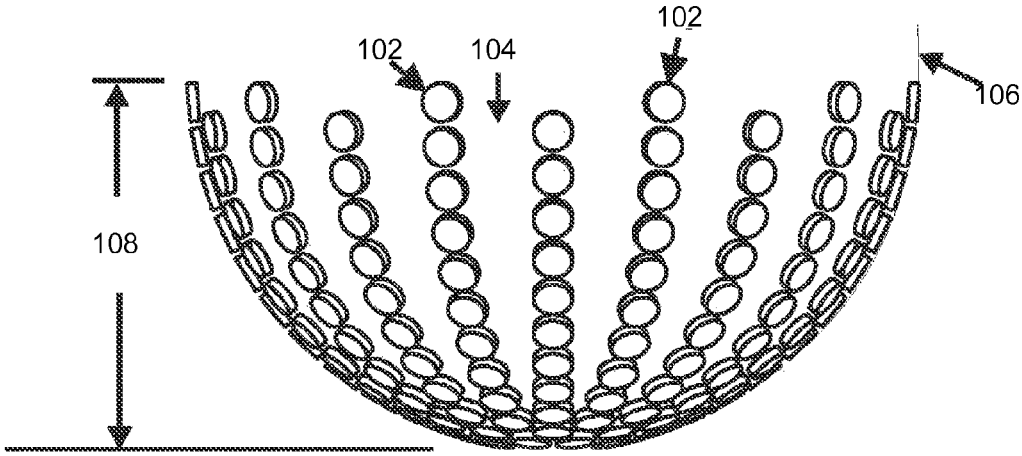
FIG. 10 illustrates a side view of an exemplary magnetic array illustrating the arrangement of the multiplicity of magnets in an exemplary array, in accordance with an embodiment of the present invention.

FIG. 10 illustrates a side view of an exemplary magnetic array illustrating the arrangement of the multiplicity of magnets in an exemplary array, in accordance with an embodiment of the present invention. In the present embodiment, the array may include the multiplicity of magnets 102. The array may also include various depths 108, radiuses 106, and diameters. Varying the space 104 may also affect the ionic flow.

Figure 11:
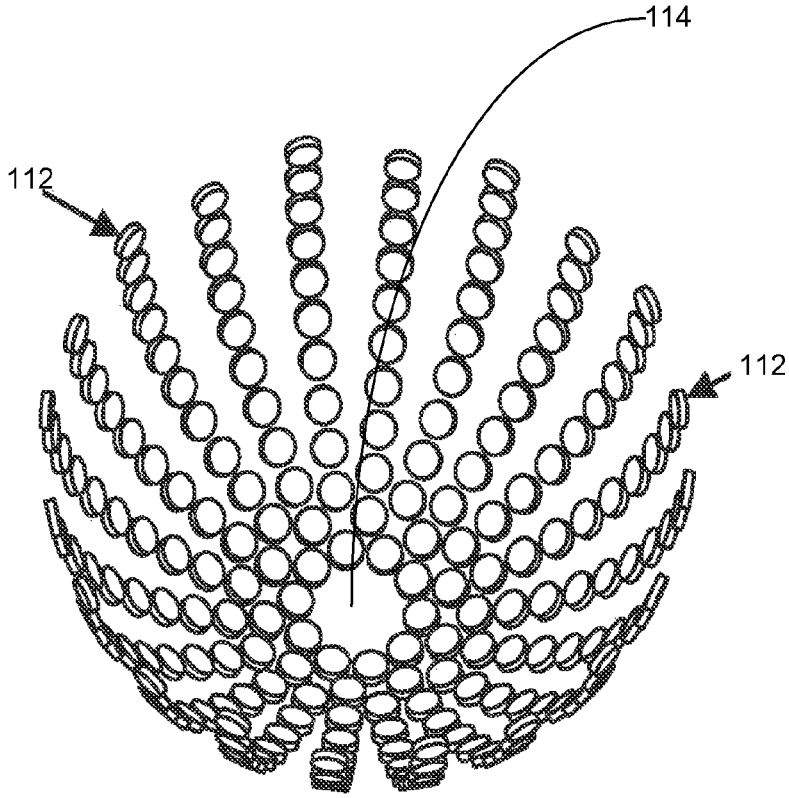
FIG. 11 illustrates an orthographic view of an exemplary magnetic array illustrating the arrangement of the multiplicity of magnets in an exemplary array, in accordance with an embodiment of the present invention.

FIG. 11 illustrates an orthographic view of an exemplary magnetic array illustrating the arrangement of the multiplicity of magnets in an exemplary array, in accordance with an embodiment of the present invention. In the present embodiment, the number of the multiplicity of magnets 112 in proximity to the aperture 114 may be similar, yet the ionic flow and the magnetic field may vary depending on other dimensions and characteristics of the array.

Figure 12:
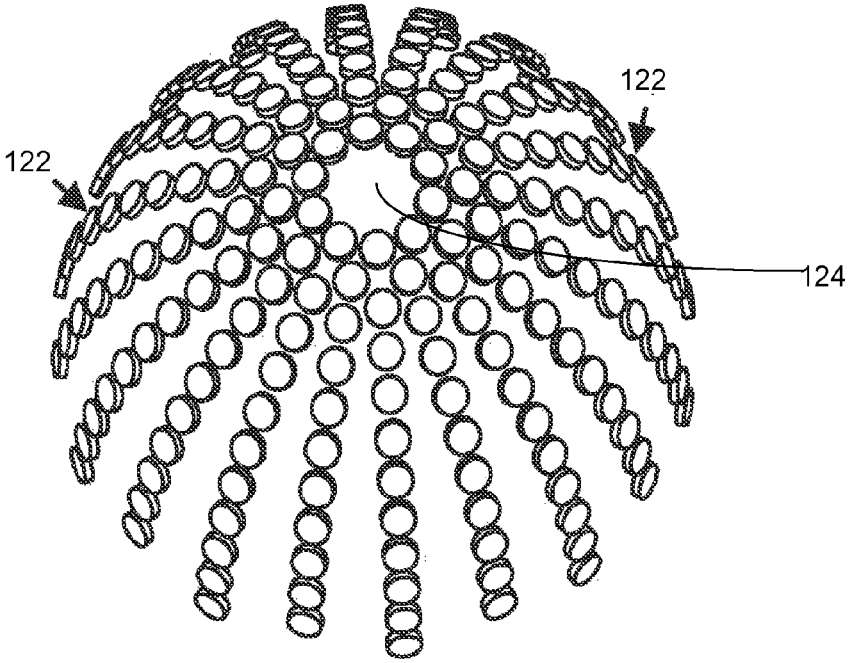
FIG. 12 illustrates an inverted orthographic view of an exemplary magnetic array illustrating the arrangement of the multiplicity of magnets in an exemplary array, in accordance with an embodiment of the present invention.

FIG. 12 illustrates an inverted orthographic view of an exemplary magnetic array illustrating the arrangement of the multiplicity of magnets in an exemplary array, in accordance with an embodiment of the present invention. In the present embodiment, the space between the multiplicity of magnets 122 may be large in relation to the surface area of the array. The aperture 124 may position on a focal point of the array. However, in one alternative embodiment, the aperture may be oriented in proximity to the focal point. In another alternative embodiment, the aperture may be oriented in proximity to the focal point and additionally slightly cocked to the side.

Figure 13:
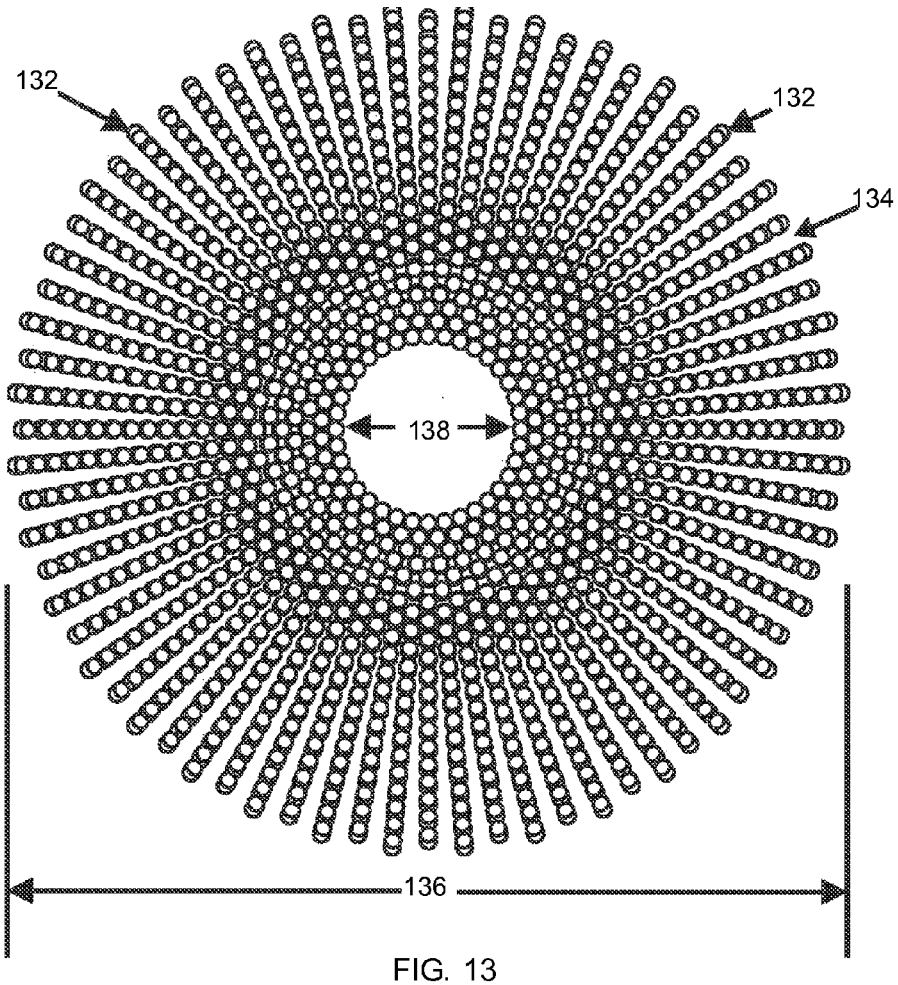
FIG. 13 illustrates a top view of an exemplary magnetic array illustrating the arrangement of the multiplicity of magnets in an exemplary array, in accordance with an embodiment of the present invention.

FIG. 13 illustrates a top view of an exemplary magnetic array illustrating the arrangement of the multiplicity of magnets in an exemplary array, in accordance with an embodiment of the present invention. In the present embodiment, the multiplicity of magnets 132 may include a greater quantity relative to the outside diameter of the array. The depth of the array may also be shallower relative to the diameter 136 of the array. In yet another embodiment, the aperture at the base 138 of the array may also be larger relative to the diameter of the array. Those skilled in the art, in light of the present teachings will recognize that varying the space 134 between the rows and rings of magnets may also affect the ionic flow.

Figure 14:
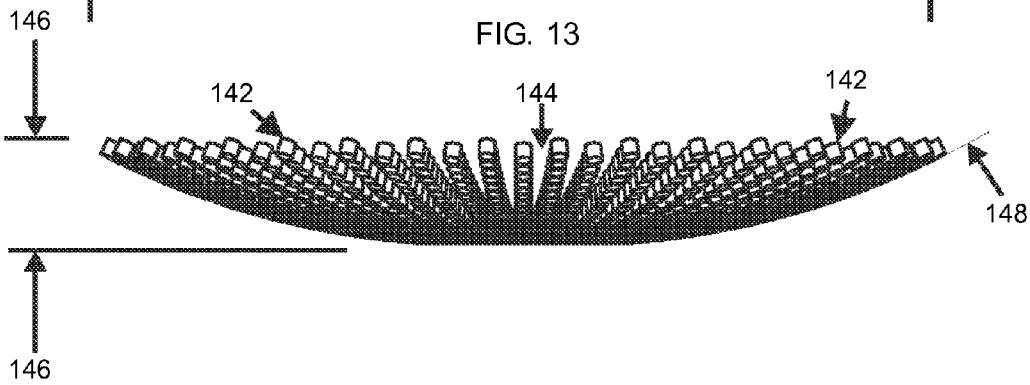
FIG. 14 illustrates a side view of an exemplary magnetic array illustrating the arrangement of the multiplicity of magnets in an exemplary array, in accordance with an embodiment of the present invention.

FIG. 14 illustrates a side view of an exemplary magnetic array illustrating the arrangement of the multiplicity of magnets in an exemplary array, in accordance with an embodiment of the present invention. In the present embodiment, the magnetic array may include various sizes and dimensions. In some embodiments, the efficacy of the multiplicity of magnets 142 may be affected by varying the diameter, the radius 148, the depth 146, and the space 144 of the array without varying the size of the aperture at a base of the array. the depth may be shallow relative to the diameter of the array.

Figure 15:
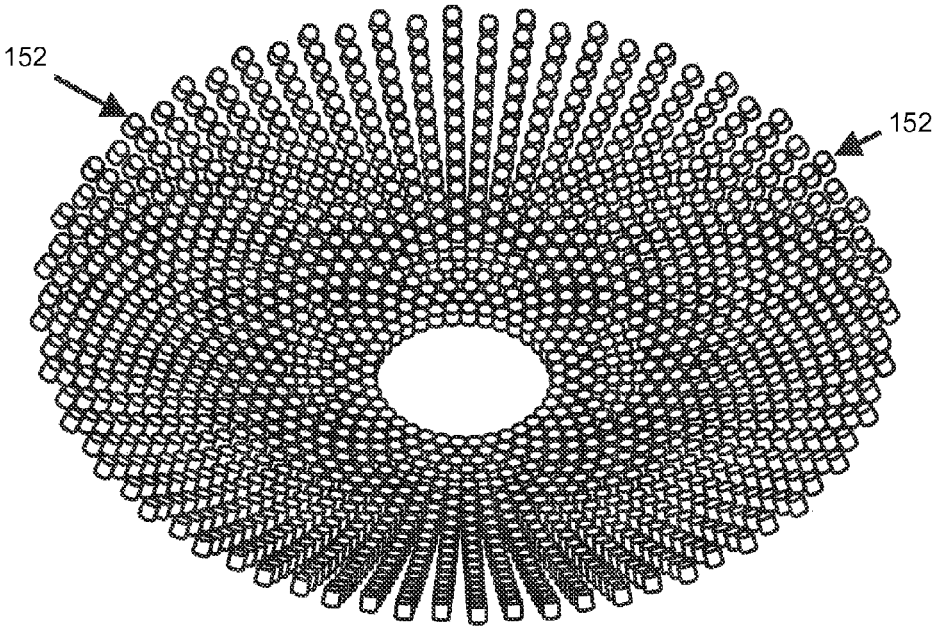
FIG. 15 illustrates an orthographic view of an exemplary magnetic array illustrating the arrangement of the multiplicity of magnets in an exemplary array, in accordance with an embodiment of the present invention.

FIG. 15 illustrates an orthographic view of an exemplary magnetic array illustrating the arrangement of the multiplicity of magnets in an exemplary array, in accordance with an embodiment of the present invention. In the present embodiment, the multiplicity of magnets 152 and the array may be rotated either clockwise or counterclockwise as required according to the desired effects and the intended application. In some embodiments, an increase in rotational speed may lead to an increase in ionic flow through the magnetic array.

Figure 16:
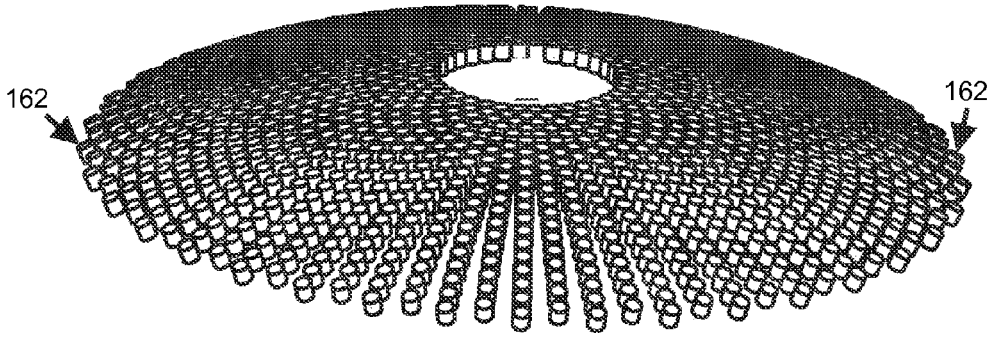
FIG. 16 illustrates an inverted view of an exemplary magnetic array illustrating the arrangement of the multiplicity of magnets in an exemplary array, in accordance with an embodiment of the present invention.

FIG. 16 illustrates an inverted view of an exemplary magnetic array illustrating the arrangement of the multiplicity of magnets in an exemplary array, in accordance with an embodiment of the present invention. In the present embodiment, moving the array in a reciprocal motion along the axis of the magnetic array may be efficacious for manipulating the ionic flow and the magnetic field. In yet another embodiment, moving the array in a wobbling fashion around the axis of the magnetic array may also be helpful for manipulating the ionic flow and the magnetic field. In the present embodiment, the array may include a larger quantity of the multiplicity of magnets 162 compared to the outside diameter of the array. The depth of the array may also be shallow relative to the diameter of the array. In yet another embodiment, the aperture at the bottom of the array may be large relative to the overall diameter of the array.

Figure 17:
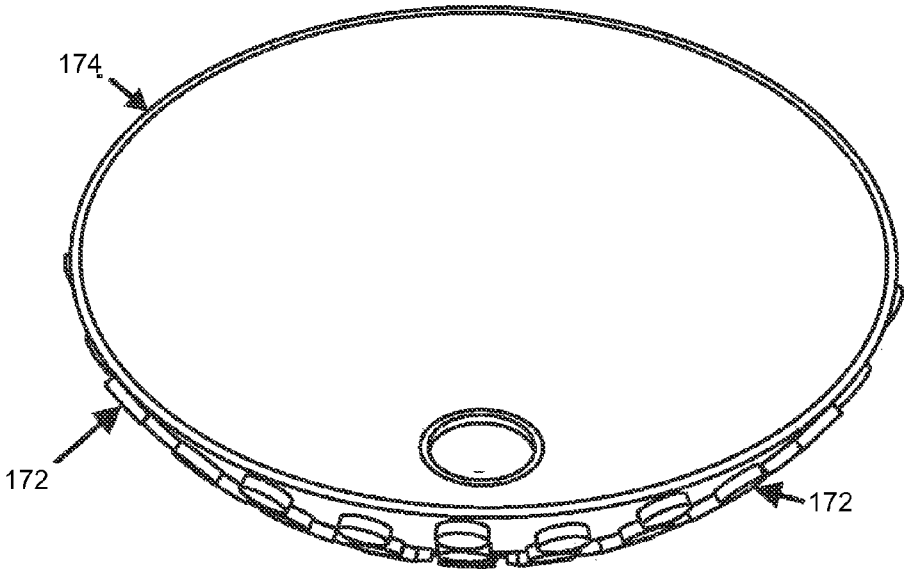
FIG. 17 illustrates an orthographic view of an exemplary magnetic array illustrating the mounting arrangement of the multiplicity of magnets in an exemplary array with a bowl shape, in accordance with an embodiment of the present invention.

FIG. 17 illustrates an orthographic view of an exemplary magnetic array illustrating the mounting arrangement of the multiplicity of magnets in an exemplary array joined with a bowl shaped substrate, in accordance with an embodiment of the present invention. In the present embodiment, the multiplicity of magnets 172 may bond to the outside of a bowl shaped substrate 174. The magnets may also bond to the inside of the bowl shaped substrate depending on the desired application. Suitable materials for fabricating the substrate may include, without limitation, plastic, ceramic, glass, metal, rubber, polyurethane, foam, metal, wood and other suitable rigid or flexible materials.

Figure 18:
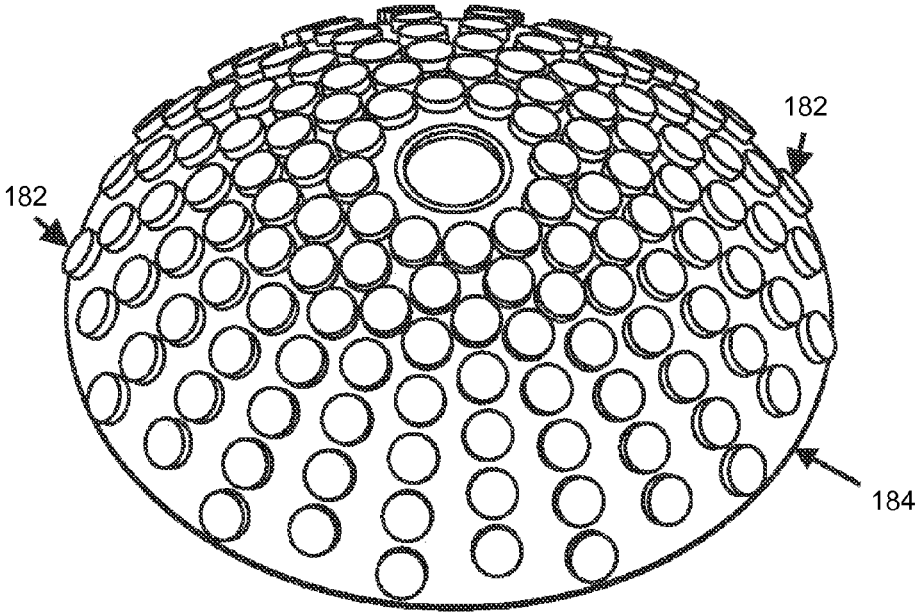
FIG. 18 illustrates an inverted view of an exemplary magnetic array illustrating the mounting arrangement of the multiplicity of magnets in an exemplary array joined with a bowl shaped substrate, in accordance with an embodiment of the present invention.

FIG. 18 illustrates an inverted view of an exemplary magnetic array illustrating the mounting arrangement of the multiplicity of magnets in an exemplary array joined with a bowl shaped substrate, in accordance with an embodiment of the present invention. In the present embodiment, the multiplicity of magnets 182 may position on an outside surface of the substrate 184. The substrate may include a substrate aperture. Those skilled in the art, in light of the present teachings will recognize that the substrate aperture may not be required since the ionic flow is not hindered by many materials. In some embodiments, the magnetic array may be fully encapsulated so that the bowl shape is not visible, yet still affect the at least one object since the magnetic field and ionic flow is not affected by many materials. In this manner, the magnetic array may be hidden within a wall, furniture, or other object and the beneficial effects may still be realized.

Figure 19:
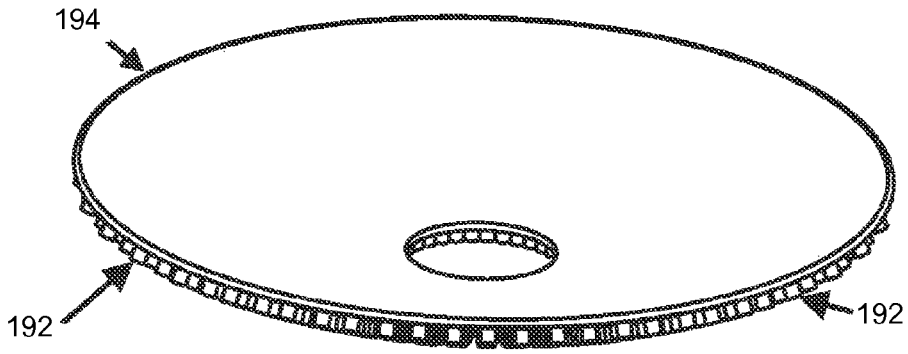
FIG. 19 illustrates an orthographic view of an exemplary magnetic array illustrating the mounting arrangement of the multiplicity of magnets in an exemplary array joined with a bowl shaped substrate, in accordance with an embodiment of the present invention.

FIG. 19 illustrates an orthographic view of an exemplary magnetic array illustrating the mounting arrangement of the multiplicity of magnets in an exemplary array joined with a bowl shaped substrate, in accordance with an embodiment of the present invention. In the present embodiment, the multiplicity of magnets 192 may position on an outside surface of the substrate 194. The substrate may include a shallow depth.

Figure 20:
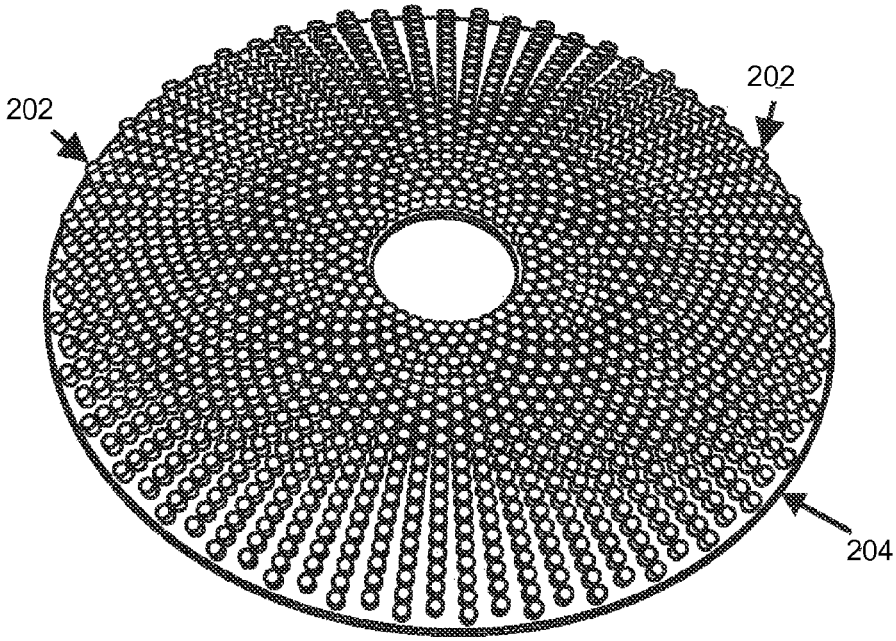
FIG. 20 illustrates an inverted view of an exemplary magnetic array illustrating the mounting arrangement of the multiplicity of magnets in an exemplary array joined with a bowl shaped substrate, in accordance with an embodiment of the present invention.

FIG. 20 illustrates an inverted view of an exemplary magnetic array illustrating the mounting arrangement of the multiplicity of magnets in an exemplary array joined with a bowl shaped substrate, in accordance with an embodiment of the present invention. In the present embodiment, the multiplicity of magnets 202 may join with a substrate 204 having a shallow depth. Those skilled in the art, in light of the present teachings will recognize that the substrate may dictate the form of the array.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing an induced ionic flow that is oriented to focus on a focal point in a magnetic array for manipulating objects positioned inside the magnetic array according to the present invention will be apparent to those skilled in the art. Various aspects of the invention have been described above by way of illustration, and the specific embodiments disclosed are not intended to limit the invention to the particular forms disclosed. The particular implementation of the induced ionic flow that is oriented to focus on a focal point in a magnetic array for manipulating objects positioned inside the magnetic array may vary depending upon the particular context or application. By way of example, and not limitation, the induced ionic flow that is oriented to focus on a focal point in a magnetic array for manipulating objects positioned inside the magnetic array described in the foregoing were principally directed to a bowl shaped magnetic array that induced an ionic flow oriented to focus on a focal point in the magnetic array for manipulating objects positioned inside the magnetic array implementations; however, similar techniques may instead be applied to controlling ferromagnetic materials in nanomaterials and microscopic spaces, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A magnetic array, comprising:

a plurality of magnets, said plurality of magnets comprising a plurality of north poles, said plurality of magnets further comprising a plurality of south poles, said plurality of magnets being disposed to form an array, said array comprising a wide end, said array further comprising a narrow end, said narrow end comprising an aperture, said plurality of magnets being operable to induce an ionic flow, said ionic flow being disposed to flow from said wide end towards said aperture, said ionic flow being operable to increase when in proximity to said narrow end, said ionic flow being operable to manipulate at least one object positioned in proximity to said array, wherein said array comprises a diameter, said array further comprising a depth, said array further comprising a base and said array further comprising a radius for a parabolic curvature of said magnetic array.

2. The magnetic array of claim 1, wherein said ionic flow is operable to force said at least one object from said wide end towards said aperture.

3. The magnetic array of claim 2, wherein said ionic flow is operable to reverse direction after passing said aperture.

4. The magnetic array of claim 3, in which said ionic flow induces a magnetic field.

5. The magnetic array of claim 1, wherein said plurality of north poles and said plurality of south poles face opposite directions.

6. The magnetic array of claim 5, wherein said plurality of north poles orient towards said narrow end.

7. The magnetic array of claim 1, in which said array comprises a bowl shape.

8. The magnetic array of claim 1, wherein said plurality of magnets comprise variable sizes, orientations and magnitudes.

9. The magnetic array of claim 8, wherein said plurality of magnets are disposed to orient in a plurality of rings in proximity to said narrow end.

10. The magnetic array of claim 1, in which said magnetic array comprises a plurality of electromagnets.

11. The magnetic array of claim 10, wherein said plurality of electromagnets is configured to be electronically sequenced to simulate movement from said plurality of magnets.

12. The magnetic array of claim 11, in which said magnetic array comprises a substrate, said substrate being configured to join with said plurality of magnets.

13. The magnetic array of claim 12, in which said substrate comprises a bowl shape.

14. The magnetic array of claim 13, in which said substrate comprises a substrate wide end, said substrate further comprising a substrate narrow end, said substrate narrow end comprising a substrate aperture.

15. The magnetic array of claim 14, wherein said plurality of magnets are disposed to position on an inside surface of said substrate.

16. The magnetic array of claim 15, wherein said plurality of magnets are configured to be oriented in a random pattern so as to leave a minimum area without said plurality of magnets between a space in said substrate.

17. The magnetic array of claim 16, wherein said array rotates around an axis of said substrate.

18. A magnetic array, consisting of:

a plurality of magnets, said plurality of magnets comprising a disk shape, said plurality of magnets being disposed to form an array, said array comprising a bowl shape, said array further comprising a wide end, said array further comprising a narrow end, said narrow end comprising an aperture, said plurality of magnets comprising a plurality of north poles, said plurality of north poles being disposed to orient towards said narrow end, said plurality of magnets further comprising a plurality of south poles, said plurality of magnets being operable to induce an ionic flow, said ionic flow being disposed to flow from said wide end towards said aperture, said ionic flow being operable to increase when in proximity to said narrow end, said ionic flow being operable to manipulate at least one object positioned in proximity to said array, said ionic flow being more concentrated in proximity to said narrow end, said ionic flow being operable to reverse at a point beyond said aperture; and a substrate, said substrate comprising a bowl shape, said substrate being configured to join with said plurality of magnets, said comprising a substrate wide end, said substrate further comprising a substrate narrow end, said substrate narrow end comprising a substrate aperture, said multiplicity of magnets being disposed to position on an inside surface of said substrate.

* * * * *